United States Patent [19]

Winther

[11] Patent Number: 4,574,026

[45] Date of Patent: Mar. 4, 1986

[54] DAMPED WATERBED MATTRESS AND METHOD FOR MANUFACTURING SAME

[75] Inventor: Howard A. Winther, Union City, Calif.

[73] Assignee: Royal Waterbeds, Inc., Ellisville, Mo.

[21] Appl. No.: 567,466

[22] Filed: Jan. 3, 1984

[51] Int. Cl.[4] ..... B29C 65/04

[52] U.S. Cl. ..... 156/274.4; 5/451; 156/275.1; 156/290; 156/297; 156/308.4; 156/380.6

[58] Field of Search ..... 156/274.4, 275.1, 290, 156/292, 297, 380.6, 65, 308.2, 308.4; 5/451, 450, 452, 457

[56] References Cited

U.S. PATENT DOCUMENTS

| | | | |
|---|---|---|---|
| 4,204,289 | 5/1980 | Fogel | 5/451 |
| 4,229,929 | 10/1980 | Vajtay | 156/218 |
| 4,345,348 | 8/1982 | Hall | 5/451 |
| 4,420,356 | 12/1983 | Carpenter | 156/274.4 |

*Primary Examiner*—Michael Wityshyn

*Attorney, Agent, or Firm*—Coburn, Croft & Putzell

[57] ABSTRACT

A damped waterbed mattress includes an envelope or bladder made of vinyl or other flexible, nonporous elastomeric material and which contains a plurality of modular internal "cells" that are in intentionally restricted fluid communication with one another. These cells are themselves partitioned into at least an inner and an outer chamber that are, likewise, in restricted or metered fluid communication with each other. The top of each cell preferably includes a lighter-than-water portion, such as a small sheet of foam, while the bottom of each cell preferably includes a heavier portion, such as a heavier gauge of vinyl. Thus the cells, along with the chambers contained therein, are filled with water upon the filling of the waterbed proper, and are maintained in their filled and expanded state by virtue of the positive buoyancy of their top surfaces and the more negative buoyancy of their bottom surfaces. The chambers and cells are formed by placing hollow dies whose inner surface and opposing edges are covered by a vinyl band between vinyl sheets, bonding and collapsing one side of the chamber or cell through the hollow cavity of the die.

3 Claims, 14 Drawing Figures

DAMPED WATERBED MATTRESS AND METHOD FOR MANUFACTURING SAME

BACKGROUND OF THE INVENTION

This invention relates to waterbed mattresses, and in particular to "waveless" or damped waterbeds and their construction.

Waterbeds, or fluid flotation sleeping systems, have become increasingly popular in recent years. A waterbed provides comfortably uniform support and imparts a pleasant fluid effect to the user's body.

Early waterbed designs were little more than fluid filled vinyl envelopes or "bags". These designs indeed provided support, but any movement or touching of the bed would subject the user to an often unsettling rocking motion.

In order to alleviate this rocking motion, many waterbeds have been developed which incorporate foam inserts, hydraulic "springs", or the like. Hydraulic springs offer promise in alleviating undesired wave motion. However, difficulties have been encountered in construction which have heretofore not been addressed.

SUMMARY OF THE INVENTION

A damped waterbed mattress is provided which includes an envelope or bladder made of vinyl or other flexible, nonporous elastomeric material and which contains a plurality of modular internal "cells" that are in intentionally restricted fluid communication with one another. These cells are themselves partitioned into at least an inner and an outer chamber that are, likewise, in restricted or metered fluid communication with each other. The top of each cell preferably includes a lighter-than-water portion, such as a small sheet of foam, while the bottom of each cell preferably includes a heavier portion, such as a heavier gauge of vinyl. Thus the cells, along with with the chambers contained therein, are filled with water upon the filling of the waterbed proper, and are maintained in their filled and expanded state by virtue of the positive buoyancy of their top surfaces and the more negative buoyancy of their bottom surfaces. The chambers and cells are formed by placing hollow dies whose inner surface and opposing edges are covered by a vinyl band between vinyl sheets, bonding and collapsing one side of the chamber or cell through the hollow cavity of the die.

When filled, the waterbed mattress will support a user or users in traditional fashion, but because of the baffling effect of the unrestricted fluid communication between the cells and the chambers contained therein, the mattress will not be subject to the wave motion encountered in a typical waterbed.

Further objects and advantages of the invention will be clear upon reference to the following detailed description taken in conjunction with the accompanying drawings.

BRIEF DESCRIPTION OF THE DRAWINGS

FIG. 4A is a perspective view of the common top vinyl sheet of the cells of a damped waterbed spread out on the base or bottom electrode of a vinyl welding machine;

FIG. 4B is a perspective view of prescored foam flotation pieces in place against the top vinyl sheet;

FIG. 4C is a perspective view of vinyl-wrapped internal chamber dies in place against the foam flotation pieces and top vinyl sheet;

FIG. 4D is a cross-sectional view taken along line 4D—4D of FIG. 4C;

FIG. 4E is a perspective view of vinyl sheets for forming the bottom of individual cells in place against the vinyl wrapped internal chamber cies and showing a portion of the top electrode of the welding machine;

FIG. 4F is a cross-sectional view taken along line 4F—4F of FIG. 4E showing the making of an internal chamber weld;

FIG. 4G is a perspective view of the folding of individual cell bottom vinyl pieces into the internal chamber dies and the removal of internal chamber dies;

FIG. 4H is a perspective view of the vinyl wrapped external chamber dies in place against the common cell top vinyl sheet showing the spreading of individual cell vinyl dies across the vinyl wrapped external chamber dies and a portion of the top electrode of the welding machine;

FIG. 4I is a cross-sectional view taken along line 4I—4I of FIG. 4H showing the making of external chamber welds;

FIG. 4J is a perspective view of the folding of an individual cell vinyl piece into the eternal chamber dies and the removal of external chamber dies; and FIG. 4K is a perspective view of the insertion of completed cells within the waterbed envelope for final vinyl weld sealing.

DETAILED DESCRIPTION OF A PREFERRED EMBODIMENT

Figure 1:
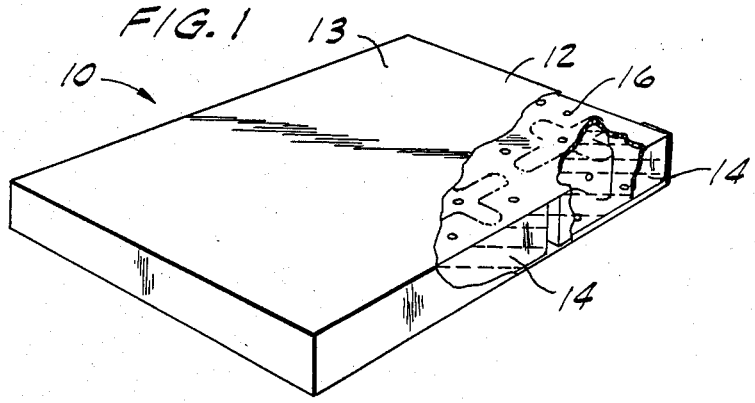
FIG. 1 is a perspective view of a damped waterbed.

Referring now to FIG. 1, a damped waterbed 10 is shown in a partially cutaway perspective view. The waterbed 10 includes a vinyl envelope 12 which encloses a plurality of cells 14, which are themselves constructed of vinyl or similar elastomeric material. An inlet valve 13 or other means is provided for filling the imperforate envelope 12. The cells 14 can be of any size, but in the preferred embodiment are approximately 23"×25"×8". Thus, nine cells placed close together in a 3×3 arrangement would approximate 72"×84"×8", which are the the dimensions of a "king-size" bed.

Figure 2:
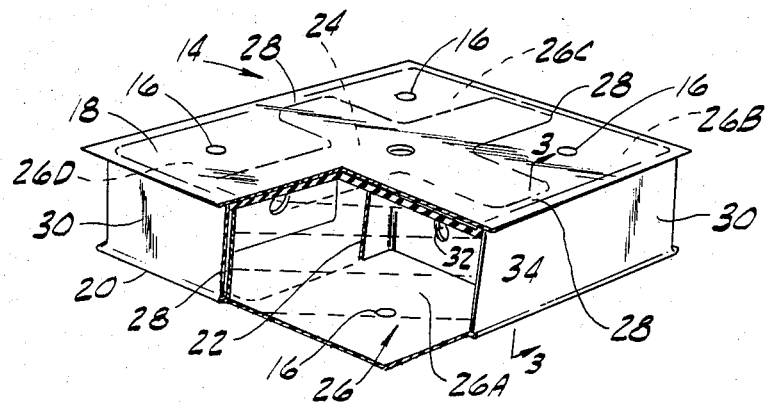
FIG. 2 is a partially cut-away perspective view of one cell of a damped waterbed.

Referring now to FIG. 2 with greater particularity, an individual cell 14 is shown. The cell 14 includes metering apertures 16 in the pliant elastomeric material forming top surface 18 and bottom surface 20, enabling restricted fluid communication between the cells 14 in the envelope 12. The size and number of these metering apertures 16 can of course be varied to achieve the desired fluid flow characteristics to give the bed its desired resistance to wave motion.

Contained within each cell 14 is a partition 22 which separates the cell into at least an inner chamber 24 and an outer chamber 26. Partition 22 is preferably a vinyl loop connected between and bonded to the top surface 18 and bottom surface 20. The partition 22 can be configured in any number of patterns to control the relative size of chambers formed by the partition 22. For example, in FIG. 2, partition 22 is shown as a closed loop in a four-arm star shape. Such a configuration results in the formation of a star-shaped inner chamber 24, and an outer chamber 26 that is effectively subdivided into four subchambers 26A, B, C and D. These subchambers are in limited fluid communication with one another by virtue of an orifice of restricted cross-section 28 that joins them, resulting from the proximity of the partition 22 to the cell side 30.

By varying the configuration of partition 22, the number of subchambers 26A–D can be varied from 1 (in the case where partition 22 forms a circle) to many (where partition 22 forms a complex, many-looped configuration). The benefit of this feature is that, by proper design, an essentially unlimited number of chambers, and, hence, restrictions to fluid flow, can be achieved. Of course, partition metering apertures 32, analogous to apertures 16, could be incorporated into partition 22 to adjust this flow.

So that cell 14 is self-supporting, that is, remains in an expanded, chambered form when filled with fluid, foam floatation piece 34 is incorporated into and proximate the top surface 18 of each cell. The foam floatation piece tends to keep the top surface 18 floating on top of the cell. Bottom surface 20, on the other hand, is preferably constructed of a vinyl material heavier than the rest of the cell 14, so that its more negative buoyancy tends to keep bottom surface 20 at the bottom of the cell. Alternatively, the bottom surface 20 is anchored to a base surface.

Figure 3:
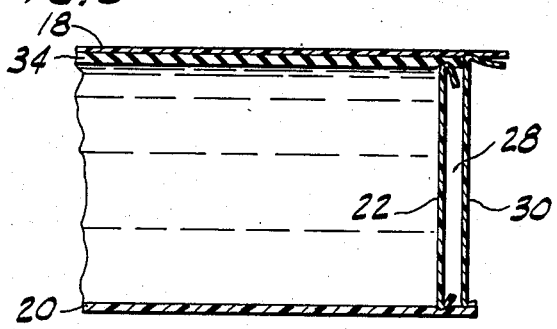
FIG. 3 is a cross-sectional view taken along line 3—3 of FIG. 2.

Referring now to FIG. 3 with greater particularity, a cross-sectional view taken along line 3—3 of FIG. 2 is shown. This view better illustrates the restricted cross-section 28 that is achieved between partition 22 and side 30. Fluid is metered between chambers through the cross-section 28.

Figure 4A:
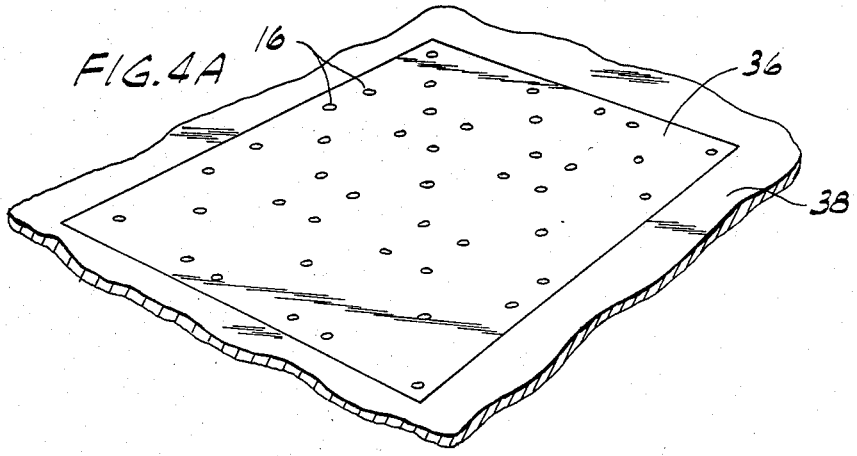
FIGS. 4A through 4K are a series of views illustrating a method of construction of a damped waterbed, specifically.

Referring now to FIGS. 4A through K, a method of manufacturing a damped waterbed is shown according to the invention. FIG. 4A shows a common cell top vinyl sheet 36 spread out on a base electrode 38 of a vinyl welding machine. Top vinyl sheet 36 is preferably the common top to the plurality of cells to be constructed. Metering apertures 16 are also shown.

Figure 4B:
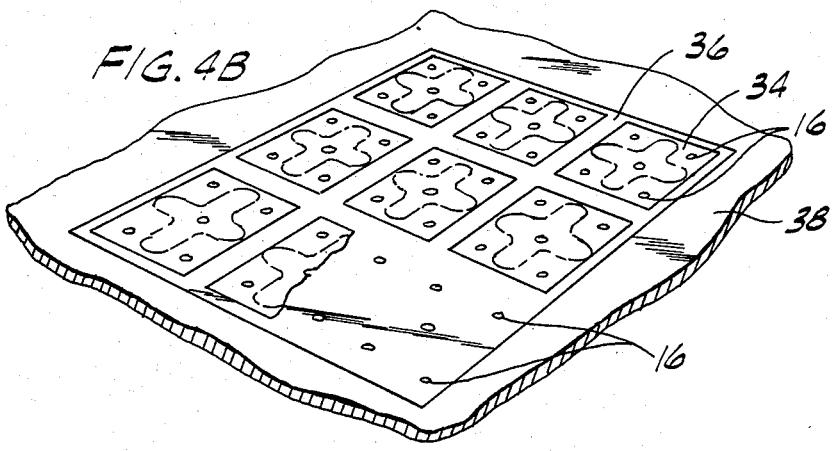

FIG. 4B illustrates the pre-scored foam floatation pieces 32 as placed on top sheet 36 and registered with metering apertures 16.

Figure 4C:
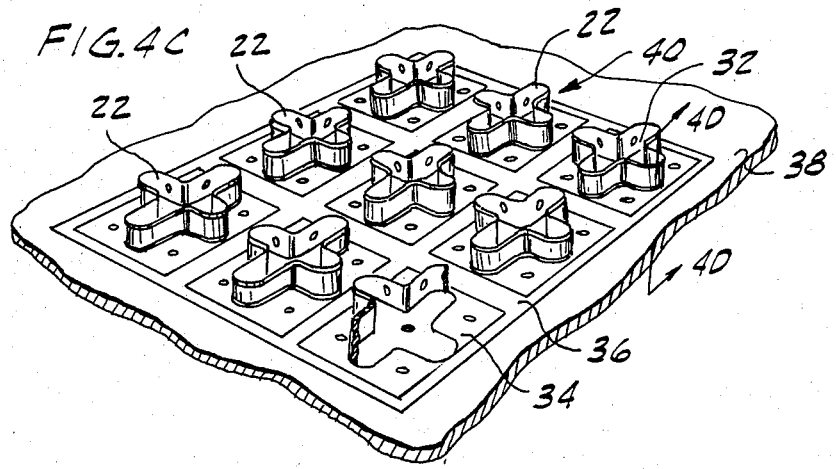
Figure 4D:
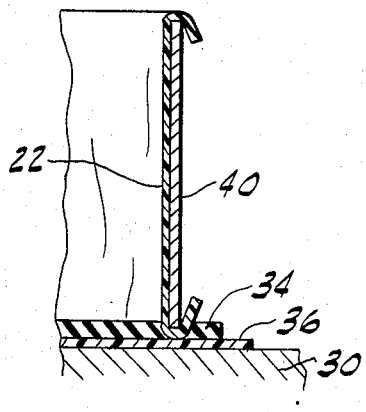

FIG. 4C illustrates the placement of vinyl-wrapped internal chamber dies 40. Dies 40 are typically made of aluminum, brass or other metal, and can be shaped in any manner, to achieve the desired partition shape discussed hereinabove. The material for partition 22 is wrapped on the inside of die 40 and draped over its top and bottom edges. This places the vinyl of partition 22 in contact with the vinyl of top sheet 36, as is more clearly shown in FIG. 4D, a cross-sectional view taken along line 4D—4D of FIG. 4C.

Figure 4F:
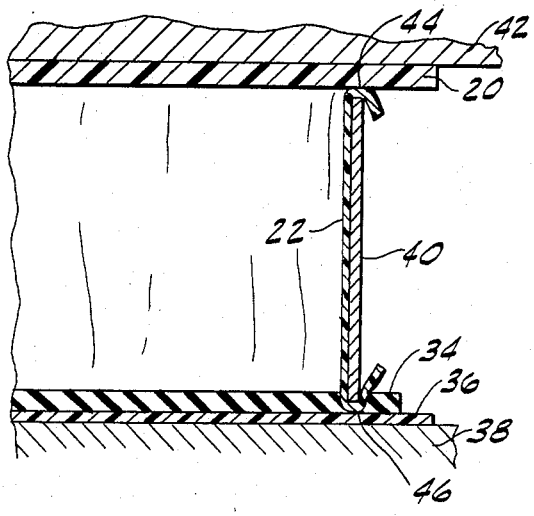
Figure 4E:
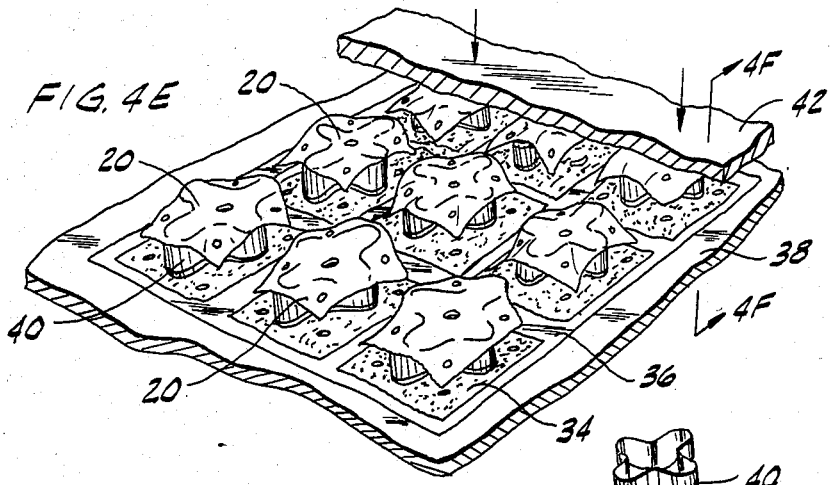

FIG. 4E illustrates the placement of the individual cell bottom vinyl sheets 20 on the vinyl-wrapped internal chamber dies 40. The top electrode 42 of the vinyl welding machine is then placed over the cells in preparation for the first weld to be made.

FIG. 4F is a cross-sectional view taken along line 4F—4F of FIG. 4E showing the making of the internal chamber weld. In this arrangement, bottom vinyl sheet 20 will be welded at 44 to partition 22, and top vinyl sheet 36 will be welded at 46 to partition 22.

Figure 4G:
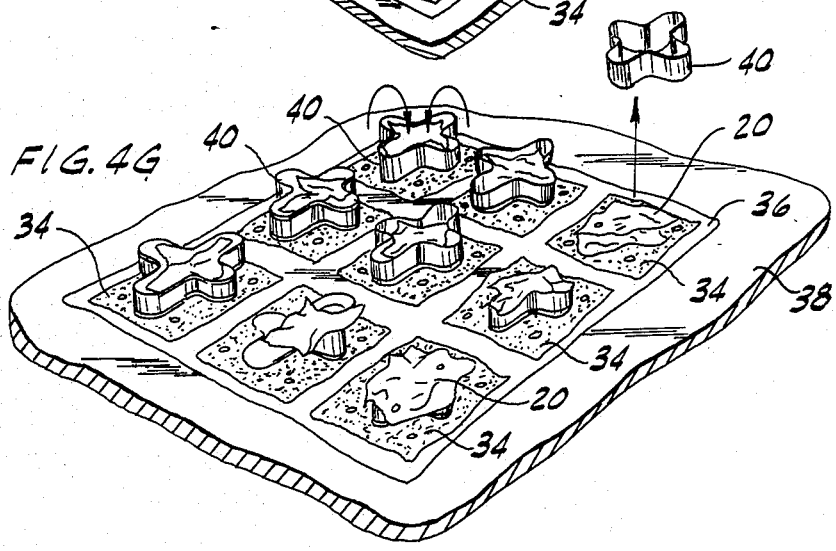

FIG. 4G shows the system after the first weld has been made and the top electrode removed. The welded bottom vinyl sheets 20 are, according to the invention, folded into the internal chamber dies 40 after the weld has been made to partition 22, and these dies 40 are then removed. It is important to note that the internal chamber dies 40 have an inwardly disposed margin forming a cavity. This method of weld formation enables the removal of the die after an internal chamber has been fully formed.

Figure 4H:
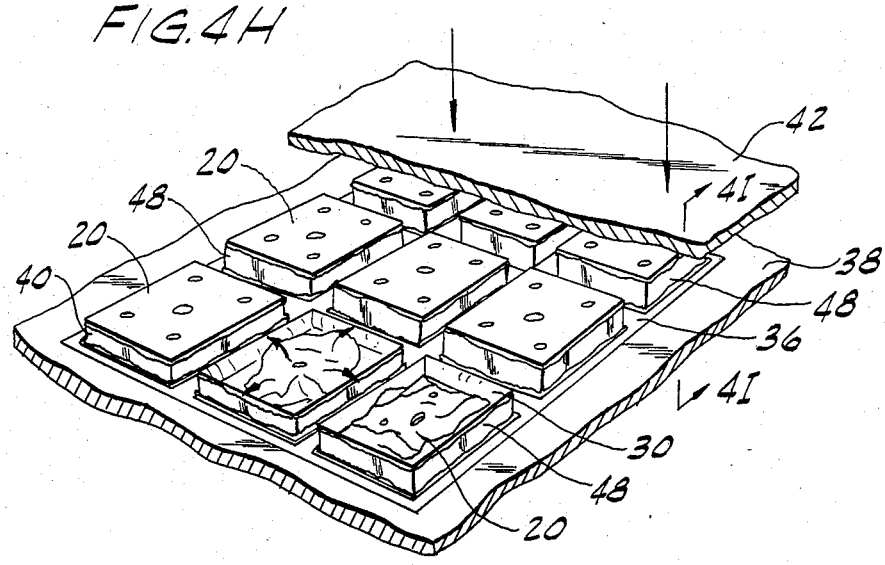

FIG. 4H illustrates the external chamber dies 48 with the material for the cell sides 30 wrapped around the inner margins of the external dies 48, which also have an inwardly disposed margin forming a cavity. Bottom vinyl sheets 20 are spread out over the perimeter of external chamber dies 48. The vinyl sheets 20 may be held in place with masking tape. Top electrode 42 is again placed over the cells, in preparation for the formation of the second weld seal.

Figure 4I:
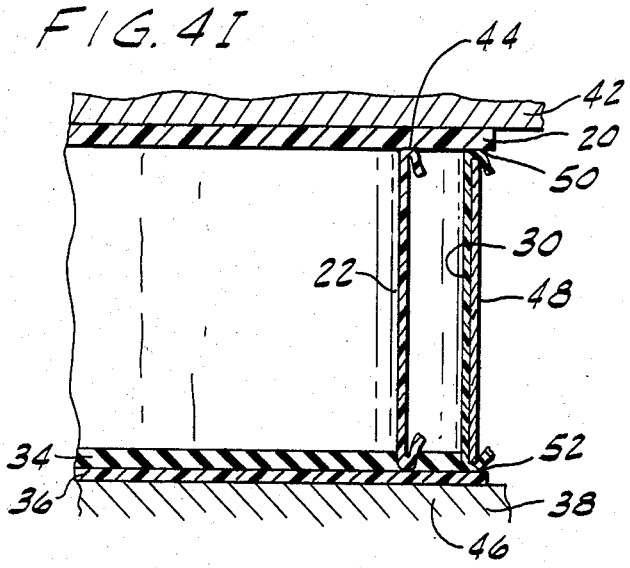

FIG. 4I is a cross-sectional view taken along line 4I—4I of FIG. 4H showing the formation of the external chamber weld. In this arrangement, bottom vinyl sheet 20 will be welded at region 50 to cell side 30, and top vinyl sheet 36 will be welded at region 52 to cell side 30.

Figure 4J:
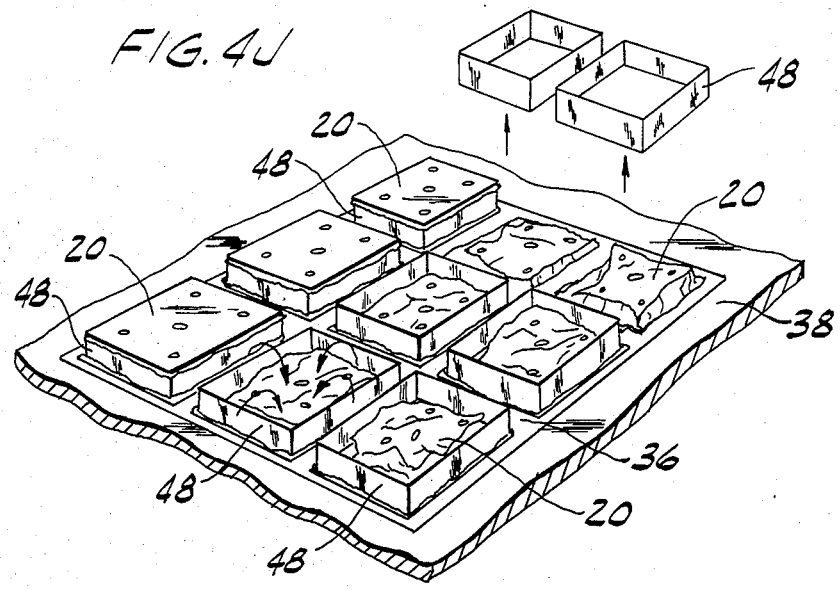

FIG. 4J shows the system after this second weld has been made and the top electrode 42 (FIG. 4I) removed. The welded bottom sheets 20 are folded within the external chamber dies 48 and then dies 48 are removed. Thus, two cells have been formed with one internal to the other in a manner adapted to large-scale mass production with minimal rearrangement of the pliant material forming the waterbed bladder.

Figure 4K:
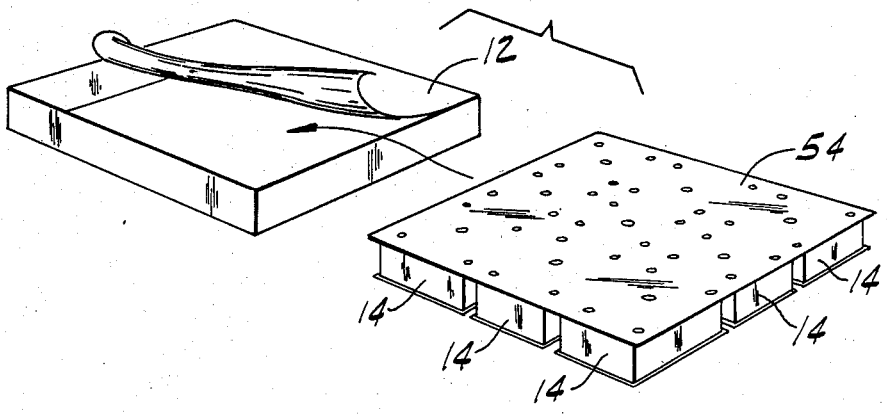

FIG. 4K illustrates the completed cell array 54 as inverted and placed within the vinyl envelope 12. Then only is the envelope 12 sealed in a standard manner to complete the waterbed.

The invention has now been explained with reference to particular embodiments, but other embodiments will be apparent to those of ordinary skill in the art in light of this disclosure. It is therefore not intended that the invention be limited except as indicated by the appended claims.

What is claimed as invention is:

1. A method for manufacturing a damped waterbed comprising the steps of:

(a) applying a first pliant elastomeric sheet to a flat supporting base;

(b) laying at least one second pliant elastomeric sheet upon said first sheet;

(c) providing at least one first die, said first die having a first margin, a second margin, and an inside surface margin adjoining said first margin and said second margin, and an outside surface margin;

(d) fitting a first loop of a third sheet to cover said first margin, said inside surface margin, and said second margin;

(e) placing said first die upon said second sheet such that said third sheet abuts said second sheet along said first margin;

(f) placing a fourth pliant elastomeric sheet upon said first die such that said third sheet abuts said fourth sheet along said second margin;

(g) bonding said second sheet to said first sheet and to said third sheet along said first margin;

(h) bonding said third sheet to said fourth sheet along said second margin thereby to form a first chamber of said fourth sheet, and second sheet and said third sheet attached to a first sheet;

(i) collapsing said chamber through said inside surface for removing said first die from said supporting base;

(j) placing a second die around each said first chamber, said second die having an inwardly disposed surface margin joining a third margin and a fourth margin, and said second die being provided with a band of a fifth pliant elastomeric sheet along said inwardly disposed surface margin and covering said third margin and said fourth margin, said third margin abutting said first sheet;

(k) placing said forth sheet upon said fourth margin abutting said fifth sheet;

(l) bonding said first sheet to said fourth sheet along said third margin; and (m) bonding said fourth sheet to said fifth sheet along said fourth margin.

2. The method according to claim 1 wherein said supporting base is a first welding terminal further including the step of mounting a flat surface second welding terminal upon said second margin after said placing of said fourth sheet, and wherein said bonding steps are simultaneous welds.

3. The method according to claim 2 wherein an array of first chambers is simultaneously formed by simultaneously bonding along a plurality of said second margins of a plurality of said dies, said array of said chambers being bonded to said first sheet.

* * * * *